US006435274B1

(12) United States Patent
Weislogel

(10) Patent No.: US 6,435,274 B1
(45) Date of Patent: Aug. 20, 2002

(54) PULSE THERMAL LOOP

(75) Inventor: Mark M. Weislogel, Conifer, CO (US)

(73) Assignee: TDA Research, Inc., Wheat Ridge, CO (US)

( * ) Notice: Subject to any disclaimer, the term of this patent is extended or adjusted under 35 U.S.C. 154(b) by 28 days.

(21) Appl. No.: 09/714,556

(22) Filed: Nov. 16, 2000

(51) Int. Cl.[7] ..... F28F 27/00
(52) U.S. Cl. ..... 165/274; 165/104.24; 62/119
(58) Field of Search ..... 165/274, 80.4, 165/286, 104.33, 104.22, 104.24, 104.28, 104.34; 174/15.1; 361/699, 700; 257/714, 715; 62/259.2, 259.4, 324.2, 324.4, 515, 119, 121

(56) References Cited

U.S. PATENT DOCUMENTS 3,834,835 A 9/1974 Jaster et al.
4,128,123 A 12/1978 Garriss et al.
4,921,041 A 5/1990 Akachi
5,127,471 A 7/1992 Weislogel
5,271,239 A * 12/1993 Rockenfeller et al. ..... 62/259.2
5,333,676 A * 8/1994 Mizuno ..... 165/104.33
5,348,076 A * 9/1994 Asakawa ..... 165/104.33
5,943,879 A * 8/1999 Sada et al. ..... 62/119
5,999,404 A * 12/1999 Hileman ..... 361/699
6,185,953 B1 * 2/2001 Sada et al. ..... 62/324.4

* cited by examiner

*Primary Examiner*—Henry Bennett
*Assistant Examiner*—Terrell McKinnon
(74) *Attorney, Agent, or Firm*—Renner, Otto, Boisselle & Sklar, LLP

(57) ABSTRACT

A pulse thermal loop heat transfer system includes a means to use pressure rises in a pair of evaporators to circulate a heat transfer fluid. The system includes one or more valves that iteratively, alternately couple the outlets the evaporators to the condenser. While flow proceeds from one of the evaporators to the condenser, heating creates a pressure rise in the other evaporator, which has its outlet blocked to prevent fluid from exiting the other evaporator. When the flow path is reconfigured to allow flow from the other evaporator to the condenser, the pressure in the other evaporator is used to circulate a pulse of fluid through the system. The reconfiguring of the flow path, by actuating or otherwise changing the configuration of the one or more valves, may be triggered when a predetermined pressure difference between the evaporators is reached.

41 Claims, 10 Drawing Sheets

PULSE THERMAL LOOP

STATEMENT REGARDING FEDERALLY SPONSORED RESEARCH

This invention was made in part with U.S. Government support under a Small Business Innovative Research (SBIR) NASA contract. The Government under the SBIR Program has certain rights in the invention.

BACKGROUND OF THE INVENTION

1. Technical Field

The invention is in the field of heat transfer devices, and methods for operating such devices. In particular, the invention relates to devices that transfer heat by moving fluid through a closed loop.

2. Description of the Related Art

Prior art closed loop thermal transport systems may generally be divided into two types, active circulation systems and passive circulation systems. Active circulation systems, such as mechanically-pumped loops, involve forcing flow through a loop containing an evaporator and a condenser, for example, utilizing any of a wide variety of mechanical pumps. Passive systems include devices such as heat pipes and capillary-pumped loops, which transport heat by evaporating and condensing the fluid, and transport the fluid through use of capillary forces.

Actively-pumped thermal loops can have the disadvantage of the weight, size, cost, and mechanical complexity that occur is systems with a pump. Passive systems avoid the disadvantages of utilizing a pump. However, passive systems exploiting capillarity may suffer from limited fluid flow and/or heat transfer capability that regulates them to situations where only small thermal and pumping loads are encountered.

It will be appreciated that there may be situations where the foregoing disadvantages of traditional systems are unacceptable. One example is for thermal systems on board satellites in which increased capabilities and decreasing size of satellites may push the requirements of on board thermal control systems beyond what can be obtained with traditional passive systems, and for which mechanically-pumped systems have unacceptable weight, size, and complexity. Another example is in cooling electronic systems, where small size and large heat removal capacity are highly desirable properties, without the added cost of a mechanical pump.

From the foregoing, it will be appreciated that a need exists for thermal systems which have greater capacity than traditional passive systems, yet avoid the size, weight, cost, and complexity of systems with mechanical pumps.

SUMMARY OF THE INVENTION

A pulse thermal loop heat transfer system includes a means to use pressure rises in a pair of evaporators to circulate a heat transfer fluid. The system includes one or more valves that iteratively, alternately couple the outlets the evaporators to the condenser. While flow proceeds from one of the evaporators to the condenser, heating creates a pressure rise in the other evaporator, which has its outlet blocked to prevent fluid from exiting the other evaporator. When the flow path is reconfigured to allow flow from the other evaporator to the condenser, the pressure in the other evaporator is used to circulate a pulse of fluid through the system. The reconfiguring of the flow path, by actuating or otherwise changing the configuration of the one or more valves, may be triggered when a predetermined pressure difference between the evaporators is reached, for example. A controller may be operatively coupled to the one or more valves to control the reconfiguration of the one or more valves. The controller may also be coupled to one or more transducers, for example include a differential pressure transducer, to gather information used in the controlling.

According to an aspect of the invention, a pulse thermal loop heat transfer system includes a pair of evaporators, each of the evaporators having an inlet and an outlet; a condenser operatively coupled to the inlet of each of the evaporators; and one or more valves between the outlets and the condenser. The one or more valves are operatively configured to selectively couple one or the other of the outlets to the condenser.

According to another aspect of the invention, a pulse thermal loop heat transfer system includes a pair of evaporators, each of the evaporators having an inlet and an outlet; a condenser operatively coupled to the inlet of each of the evaporators; and means for selectively operatively coupling each of the outlets of the evaporators to the condenser.

According to yet another aspect of the invention, a pulse method of transferring thermal energy with a heat transfer fluid in a closed system, the system including a condenser and first and second evaporators, includes iteratively switching between 1) putting the first evaporator into communication with the condenser to allow the heat transfer fluid to flow from the first evaporator to the condenser, while substantially blocking flow of the heat transfer fluid from the second evaporator to the condenser; and 2) putting the second evaporator into communication with the condenser to allow the heat transfer fluid to flow from the second evaporator to the condenser, while substantially blocking flow of the heat transfer fluid from the first evaporator to the condenser.

According to still another aspect of the invention, a pulse method of transferring thermal energy with a heat transfer fluid in a closed system, the system including a condenser and first and second evaporators, includes iteratively performing the steps of: configuring the system in a first configuration which allows flow of the fluid from the first evaporator to the condenser; waiting for a first triggering event; configuring the system in a second configuration which allows flow of the fluid from the second evaporator to the condenser; and waiting for a second triggering event.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

A pulsed thermal loop includes a pair of evaporators, a condenser operatively coupled to the evaporators, and a means, such as one or more valves, for selectively, alternately allowing fluid flow from one or the other of the evaporators to the condenser. While fluid is flowing from one of the evaporators to the condenser, a pressure rise occurs in the other of the evaporators, the evaporator for which flow output to the condenser is blocked. A pulsed flow through the loop may therefore be set up by alternately switching the flow path to couple one, then the other, of the evaporators to the condenser. This pulsed thermal flow allows for high flow and heat transfer rates in the thermal loop, without use of a mechanical pump. In addition, the pulses of flow may generate sprays of flow into the evaporators and the condenser, which further enhances the heat transfer rate of the system.

Figure 1A:
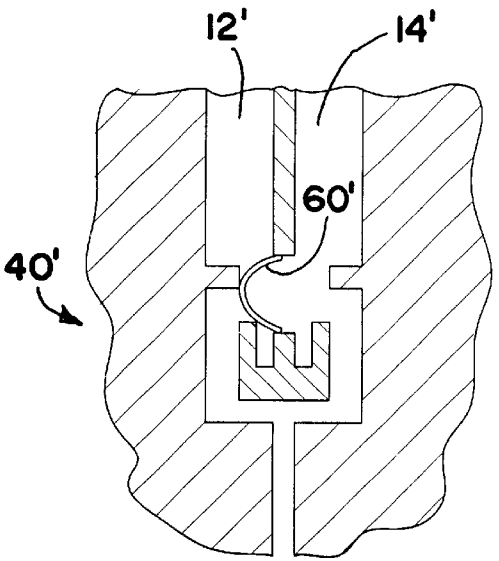
FIG. 1*a* is a side view of a passive flow selector which may be employed with a PTL in accordance with the present invention.
Figure 1:
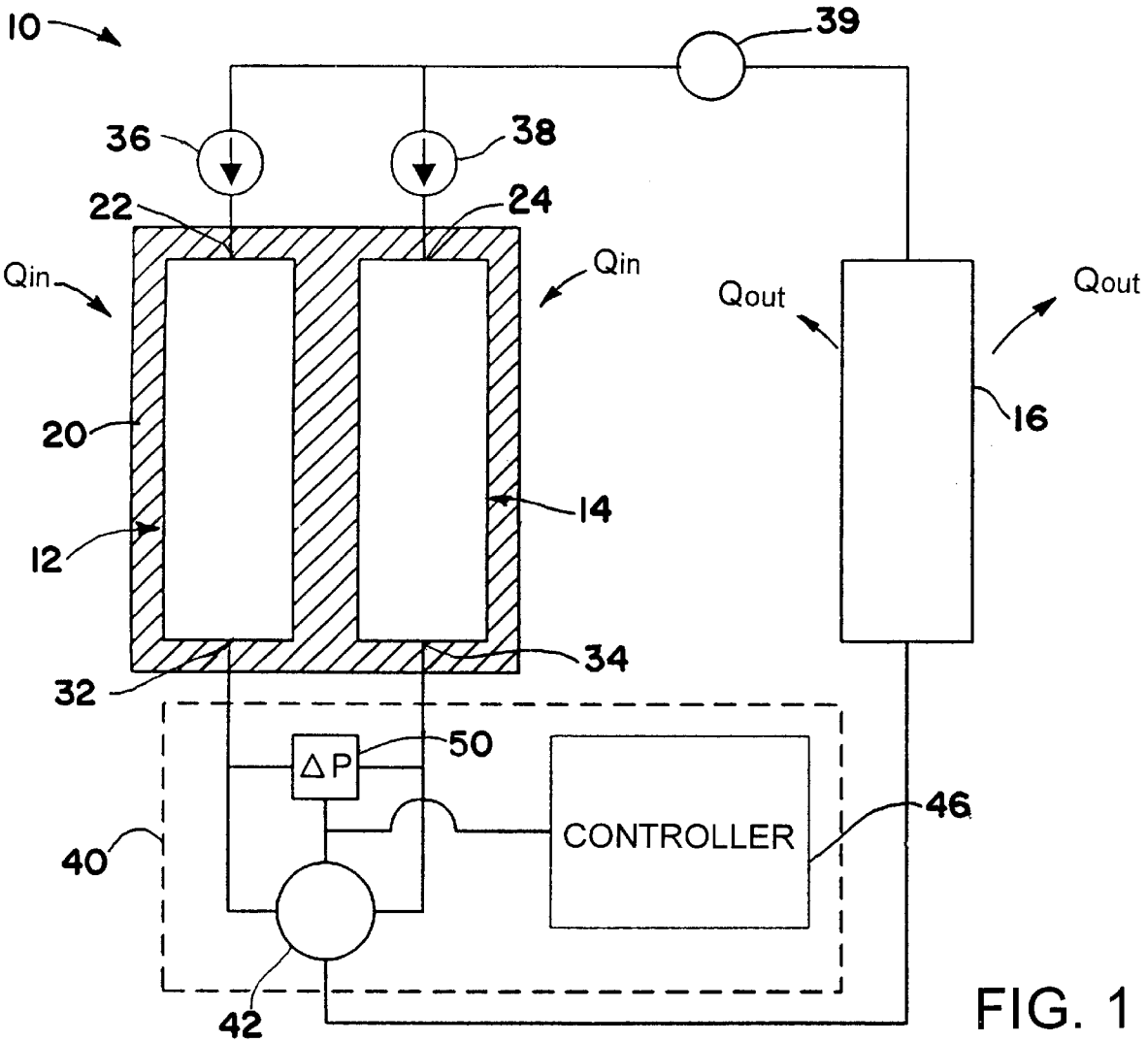
FIG. 1 is a schematic diagram of a pulsed thermal loop (PTL) in accordance with the present invention.
Figure 2:
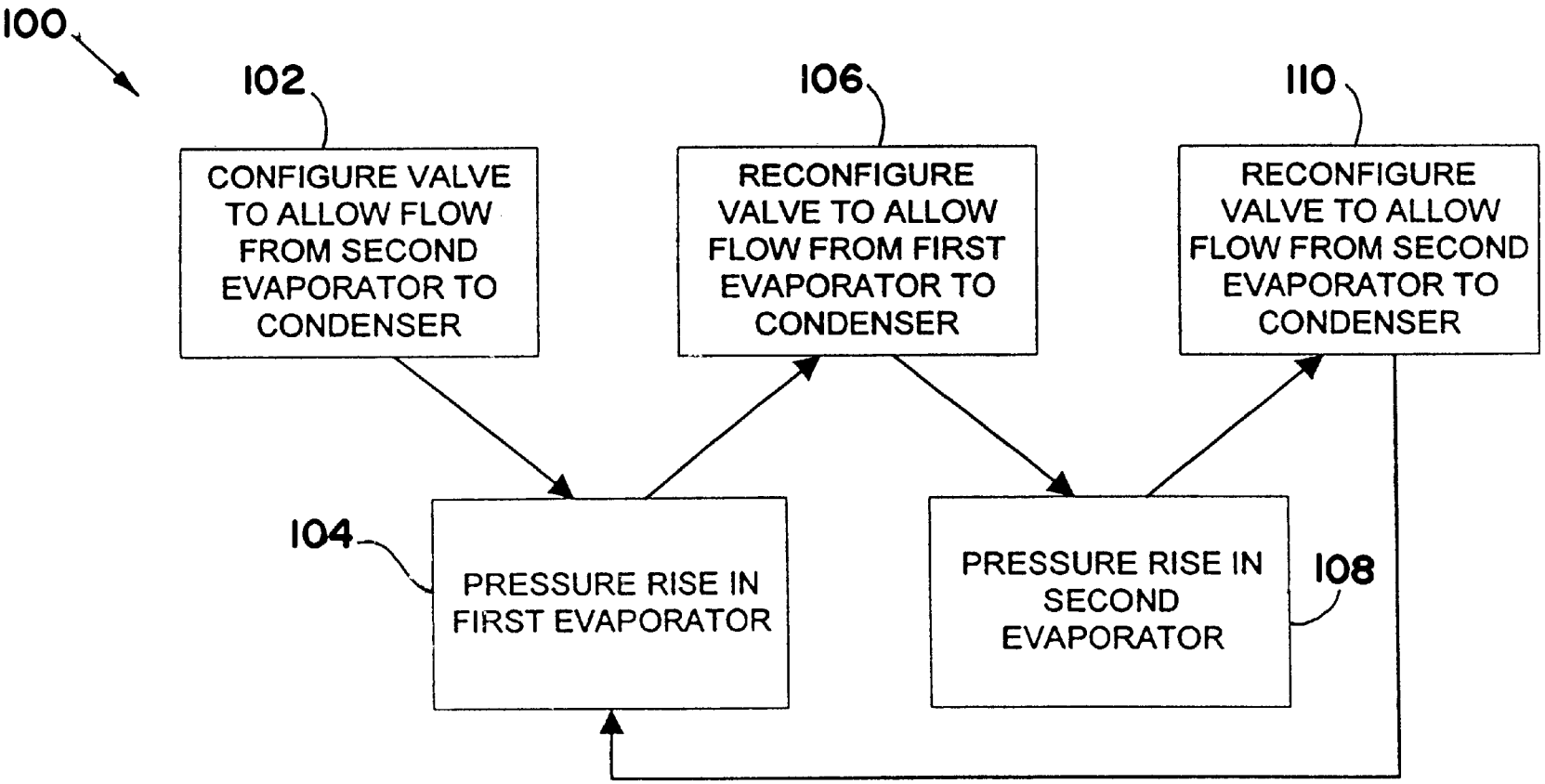
FIG. 2 is a high-level flow chart illustrating steps in the operation of the PTL of FIG. 1.

Referring initially to FIG. 1, a schematic diagram of a pulsed thermal loop (PTL) 10 is shown. The PTL 10 includes first and second evaporators 12 and 14, which are operatively coupled to a condenser 16. As described in greater detail below, a heat transfer fluid circulates through the PTL 10. The circulation of the fluid transfers heat from the evaporators 12 and 14, which receive a heating load $Q_{in}$, to the condenser 16, which transfer heat out of the system at a heat transfer rate $Q_{out}$. The heating load $Q_{in}$ may be due to one or more of a variety of heat sources or heat generation processes, including solar heating, chemical reactions, combustion, power consumption by mechanical, electrical, or electronic machinery, heat generated by crew members, etc.

The evaporators 12 and 14 may be thermally coupled together. This thermal coupling may take the form of a heated block or other thermal coupling 20, which may, for example, be a part of or be coupled to a device or process that produces heat. It will be appreciated that alternatively, the evaporators 12 and 14 may be other than thermally coupled. For example, the first evaporator 12 may be coupled to one heat source, and the second evaporator 14 may be coupled to a separate heat source. It will be appreciated that other variations are possible.

The first and second evaporators 12 and 14 have respective first and second evaporator inlet ends 22 and 24, and respective first and second evaporator outlet ends 32 and 34. In the flow path between the condenser 16 and the inlet ends 22 and 24 are respective first and second check valves 36 and 38. The check valves insure that flow proceeds only in the direction between the condenser 16 and the inlet ends 22 and 24 of the evaporators 12 and 14, and never from the first ends to the condenser.

A regulating valve 39 may be placed between the condenser 16 and the check valves 36 and 38 in order to control temperatures within PTL 10 by controlling flow through the PTL.

The PTL 10 includes a flow selector 40 for iteratively alternating a flow path connection to the condenser 16 from first one, and then the other, of the evaporators 12 and 14. To this end, the flow selector 40 includes one or more valves, such as a three-way solenoid valve 42. The solenoid valve 42 is operatively coupled to the outlet ends 32 and 34, as well as to the condenser 16. The solenoid valve 42 can be selectively configured in three ways: 1) to provide a flow path connection between the first evaporator outlet end 32 and the condenser 16, while blocking flow from the second evaporator outlet end 34 to the condenser; 2) to provide a flow path from the second evaporator outlet end 34 to the condenser 16, while blocking flow from the first evaporator outlet end 32 to the condenser 16; and 3) blocking flow from both the outlet ends 32 and 34 to the condenser 16. Suitable three-way solenoid valves are well known and widely available.

The flow selector 40 also includes a controller 46 which is operatively coupled to the solenoid valve 42, in order to control the configuration of the solenoid valve, thus controlling which of the outlet ends 32 and 34 is connected by a flow path to the condenser 16. The controller 46 may be coupled to instrumentation, such as a differential pressure transducer 50, to provide the controller with information regarding conditions in one or more parts of the PTL 10. The controller 46 may use this information in controlling of the solenoid valve 42. A variety of suitable differential pressure transducers 50 are well known in the art.

The controller 46 may include any of a variety of suitable, well known processors. An example is a personal computer equipped to receive information from the differential pressure transducer 50, and including a software algorithm that actuates or otherwise reconfigures the solenoid valve 42 when a pre-determined pressure difference is exceeded.

It will be appreciated that other instrumentation may be used in addition to or in place of the differential pressure transducer 50 described above. For example, instrumentation may be used to measure and/or determine parameters such as pressure, temperature, flow rate, quality, heat transfer rate, and the like, at one or more locations in the PTL 10. Such instrumentation may be operatively coupled to the controller 46, and information from such instruments may be used by the controller 46 in controlling the solenoid valve 42.

It will also be appreciated that one or more valves may be used in addition to or in place of the three-way solenoid valve 42 described above. For example, each of the outlet ends 32 and 34 may have a separate two-way solenoid valve between it and the condenser 16. These two-way solenoid valves may both be coupled to the controller 46 for configuring the flow path between the evaporators 12 and 14 and the condenser 16. In addition, the one or more valves may include variable-opening valves for providing control of flow rates of flow between the evaporators 12 and 14 and the condenser 16.

Alternatively, the flow selector may be a passive system, such as the flow selector 40' shown in FIG. 1*a*. The passive flow selector 40' includes a diaphragm 60', which blocks flow between one of the evaporators 12' and 14', and a condenser. The relative pressures of the evaporators 12' and 14' control the position of the diaphragm 60', allowing the diaphragm to block flow out of either the first evaporator 12' or the second evaporator 14'. The passive flow selector 40' may be configured such that the diaphragm 60' shifts position at a preset pressure differential. It will be appreciated that the passive flow selector 40' is but one example of a range of suitable passive flow selectors.

The PTL 10 described above may be used with a wide variety of fluids. As will be expected, the PTL 10 will be most efficient in heat transfer when there is phase change in the loop, i.e., where the fluid boils or vaporizes in the evaporators 12 and 14, and liquefies or condenses in the condenser 16. However, it may be possible to operate the PTL 10 to transfer heat with all-gas or all-liquid circulation of fluid.

Figure 7:
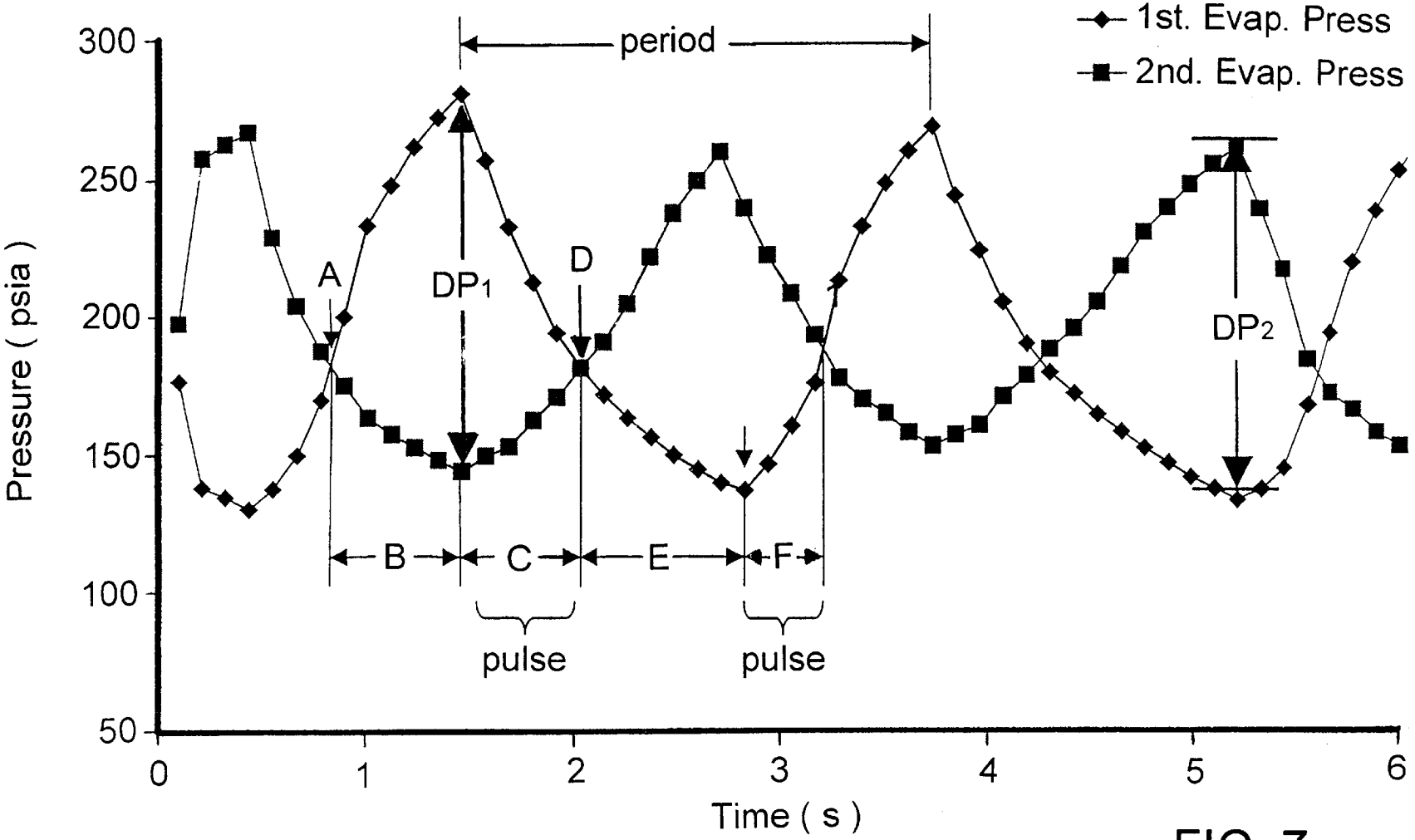
FIG. 7 is a plot of pressure vs. time for the evaporators of the PTL of FIG. 1 during the steps of the method of FIG. 2.

Turning now to FIGS. 2–7, FIG. 2 is a high-level flow chart showing the steps of a method 100 for transferring heat through the PTL loop 10 described above; FIGS. 3–6 illustrate the configuration of the PTL 10 during various of the steps of the method 100; and FIG. 7 is a pressure vs. time diagram showing the pressures at the evaporators 12 and 14 during the various steps of the method 100.

Figure 3:
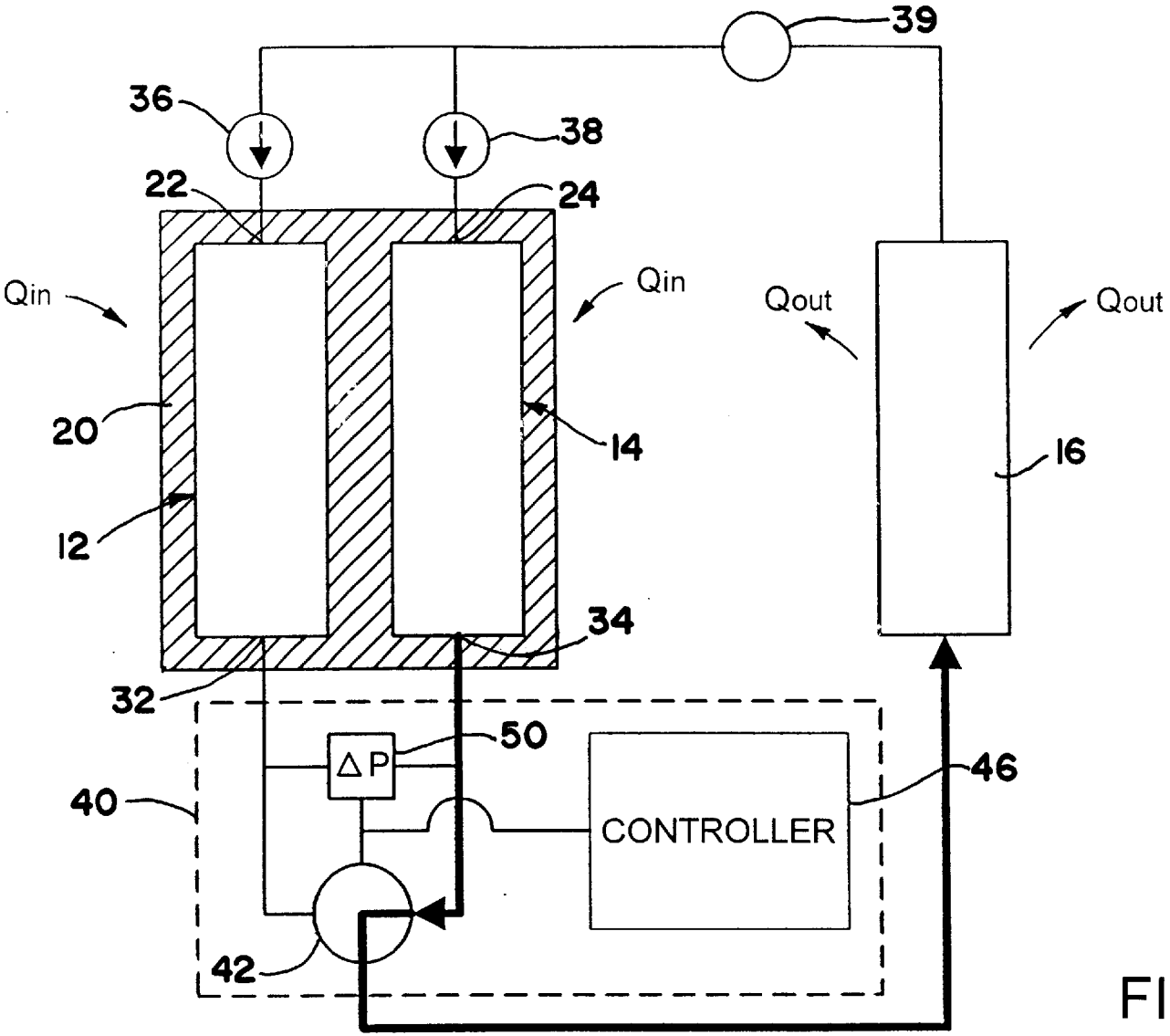
FIGS. 3–6 are schematic diagrams illustrating the configuration of the PTL during the steps of the method of FIG. 2.

In step 102, the solenoid valve 42 is actuated by the controller 46 to open a flow path between the outlet 34 of the second evaporator 14, and the condenser 16. This configuration is illustrated in FIG. 3. With the solenoid valve 42 so configured as shown in FIG. 3, no flow enters or exits the first evaporator 12, due to the presence of the first check valve 36 and due to the solenoid valve 42 blocking flow of fluid from the first evaporator outlet end 32 to the condenser 16. The step 102 corresponds to a time A, shown in FIG. 7.

In step 104 the configuration illustrated in FIG. 3 is maintained as the pressure rises in the first evaporator 12. This pressure rise occurs over a time period B, as illustrated in the pressure plot in FIG. 7. The pressure rise may be due to vaporization of some or all of the remaining liquid in the first evaporator 12, the vaporization caused by the addition of heat. In addition, some of the pressure rise may be due to the heating of the gaseous fluid in the first evaporator 12. As may be seen in FIG. 7, the pressure in the second evaporator 14 drops during the time period B. This occurs as fluid flows out of the second evaporator 14, due to the heating of the second evaporator 14, and due to the condenser 16 being at a lower pressure than the second evaporator 14.

Figure 4:
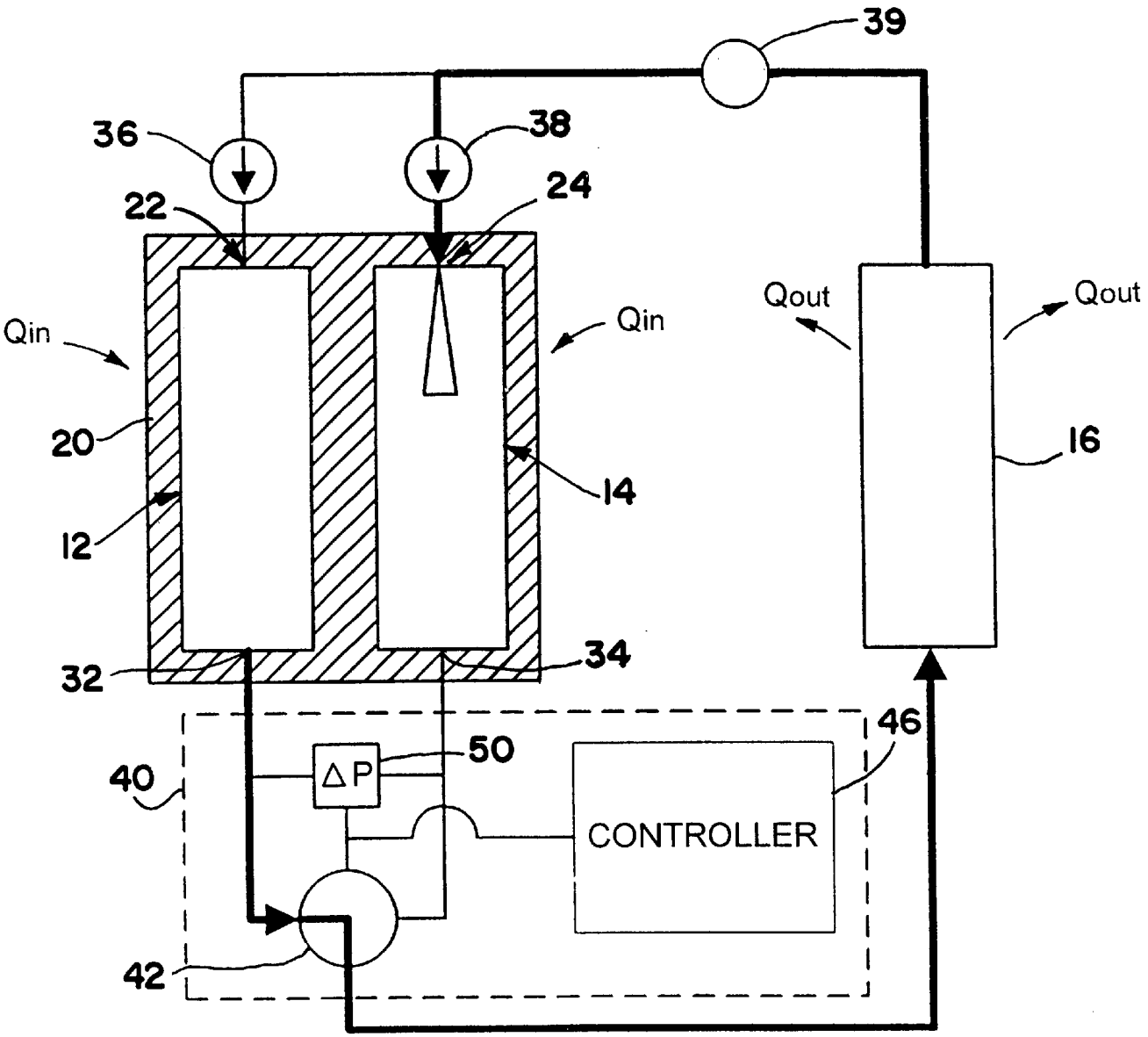

In step 106, the solenoid valve 42 is re-configured to block the flow path from the second evaporator outlet end 34 to the condenser 16, and to open a flow path from the first evaporator outlet end 32 to the condenser. As illustrated in FIG. 7, this re-configuring of the flow path is triggered when a predetermined or otherwise specified pressure differential $DP_1$ between the pressures of the evaporators 12 and 14 is reached. As illustrated in FIG. 4, the re-configuring of the solenoid valve 42 initiates a pulse of flow out of the first evaporator 12, which is at a relatively high pressure, through the condenser 16, and into the second evaporator 14, which is at a relatively low pressure. This pulsed flow occurs over a time period C (FIG. 7) during which the pressure in the first evaporator 12 exceeds the pressure in the second evaporator 14. The pulsed flow may result in condensed liquid being rapidly introduced and/or sprayed into the second evaporator 14, thereby resulting in a large amount of heat transfer. The liquid may be introduced into the evaporators 12 and 14 by one or more of various means, such as spray nozzles, nozzle manifolds, or simple injection. The evaporators 12 and 14 themselves may contain serpentine or parallel passageways and/or porous or other packings to increase surface area and enhance heat transfer. The flow of fluid into the second evaporator 14 continues until the pressures of the two evaporators are equal, this occurring at a time D (FIG. 7).

Figure 5:
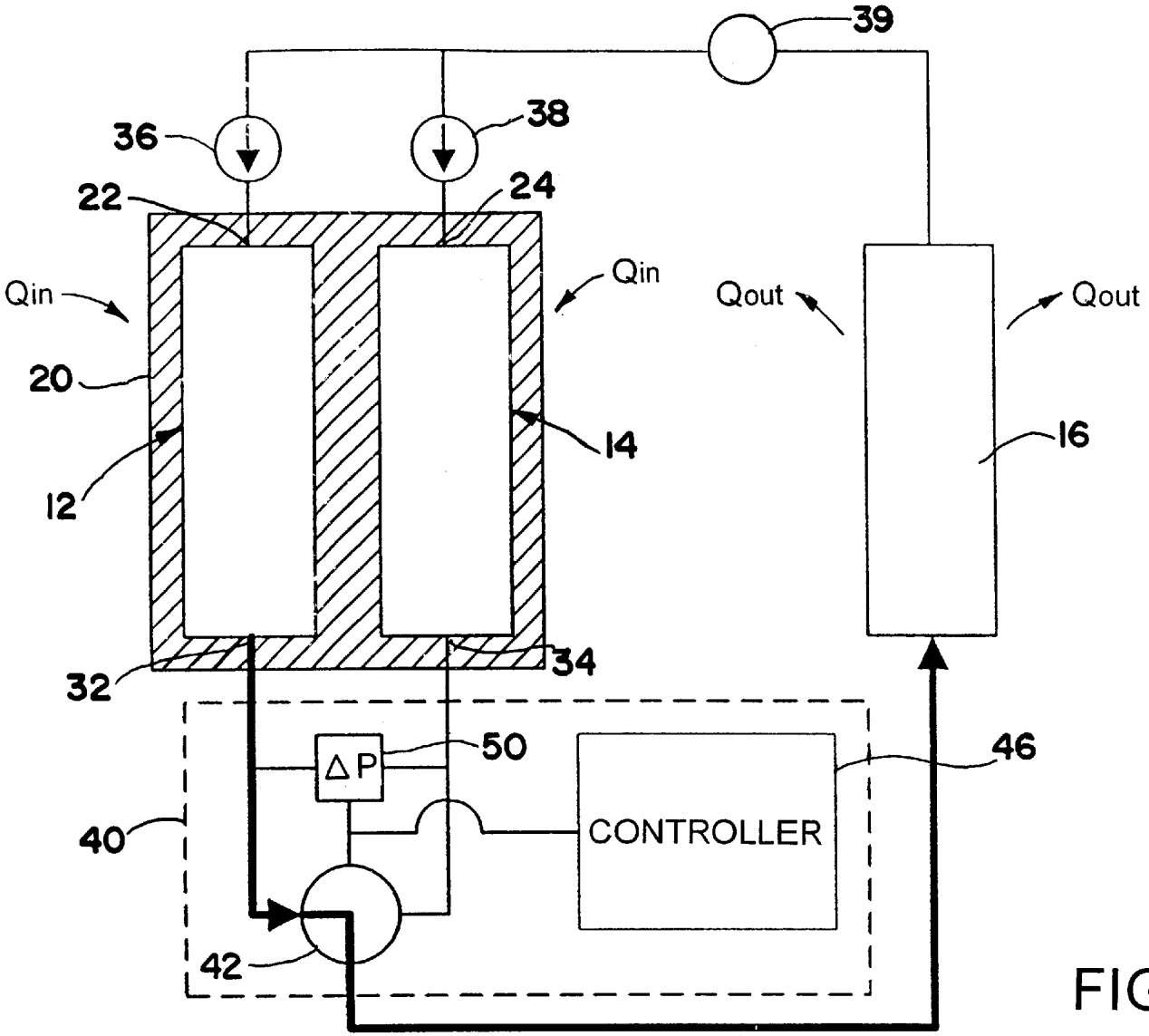
Figure 6:
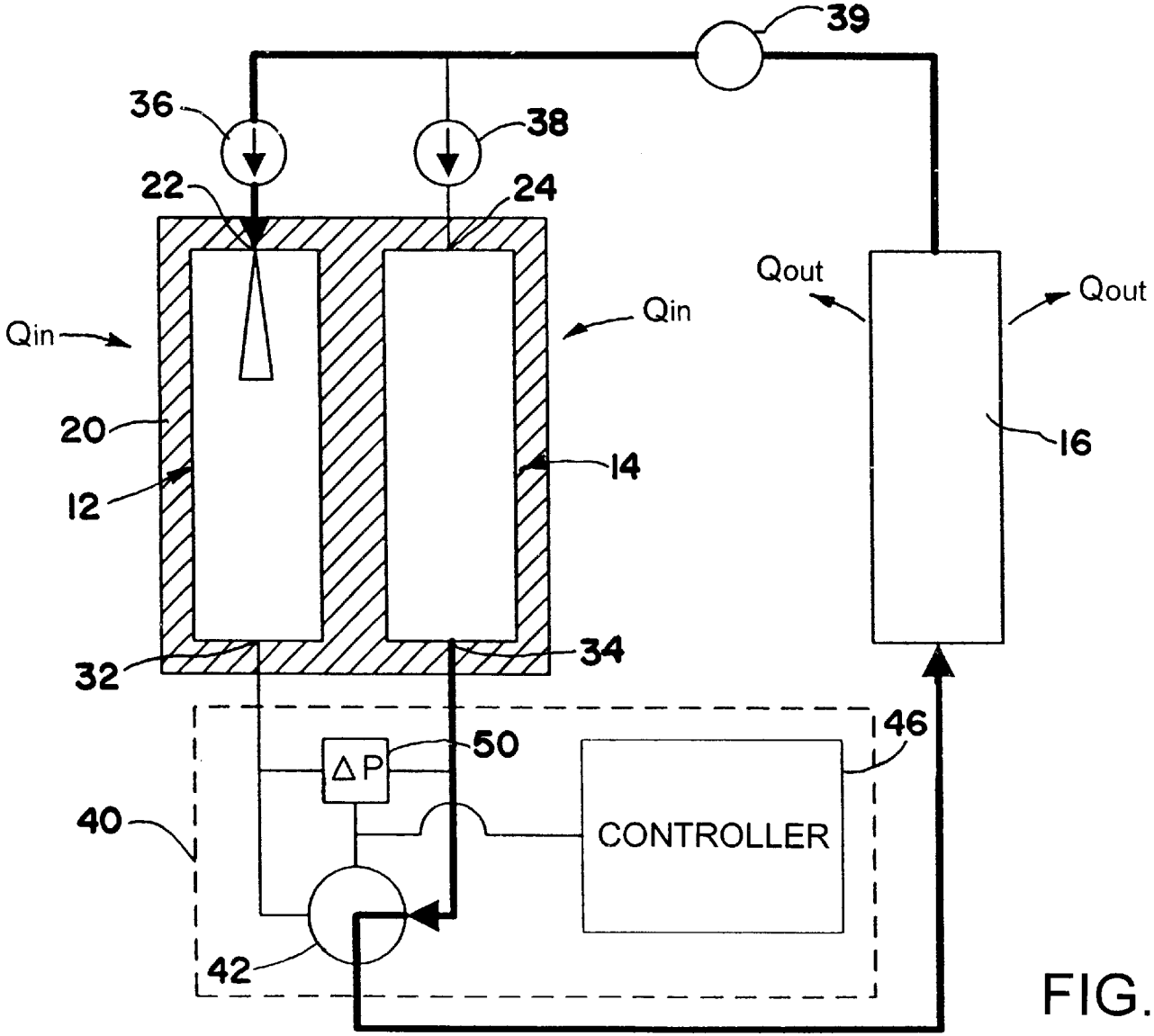

Following the equalization of pressure between the evaporators 12 and 14, at the time D, in step 108 the pressure is allowed to rise in the second evaporator 14. This is illustrated in FIG. 5. During the pressure rise, occurring over a time period E (FIG. 7), the second evaporator 14 is sealed, with no flow into or out of the second evaporator. This is because flow into or out of the outlet end 34 of the second evaporator is blocked, due to the configuration of the solenoid valve 42. In addition, the pressure of the system, such as in the condenser 16, is less than the pressure in the second evaporator 14. Therefore, there is no flow into the second evaporator across the inlet end 24. Further, the check valve 38 prevents any flow out of the inlet end 24 of the second evaporator 14. The heating of the second evaporator 14 causes a pressure rise in the second evaporator over the time period E.

When the pressure in the second evaporator 14 exceeds the pressure in the first evaporator 12 by a predetermined amount $DP_2$, the controller 46 changes to the configuration of the solenoid valve 42, in step 110. This situation, illustrated in FIG. 6, produces a pulse of flow over a time period F (FIG. 7). This pulse of flow enters the first evaporator 12, and may produce high heat transfer rates similar to that described above with regard to the pulse of liquid entering the second evaporator 14 following the re-configuration in the step 106.

Thereafter, the steps 104–110 of the method 100 may repeat, with the solenoid valve 42 actuated or re-configured to iteratively couple the outlet ends of first one, and then the other, of the evaporators 12 and 14, to the condenser 16. The time period P for entire cycle of the PTL 10 may be between 0.5 seconds and 1000 seconds, may be between one and ten seconds, or may be approximately three seconds. It will be appreciated that other periods/frequencies of operation may be used.

It will be appreciated that many variations on the above-described pulse thermal loop and method, are possible. For example, the trigger for actuating the solenoid valve may be other than a predetermined pressure differential. Alternative actuation triggers may include a pressure reading in one or the other of the evaporators 12 and 14, a temperature reading at any of a variety of locations on the PTL 10, a predetermined time since the last solenoid valve actuation, etc. It will be appreciated that the controller 46 may be configured to determine and implement a triggering criterion based on one or more of the above-described parameters.

As another example, it will be appreciated that the evaporators may be substantially identical, or may alternatively have different sizes or characteristics. The triggering event for re-configuring to allow flow out of the first evaporator 12 may be the same as, or may be different than, the triggering event for re-configuring to allow flow out of the second actuator 14. As a further example of the many possible variations, one or both of the evaporators 12 and 14 may have a vapor reservoir coupled thereto.

Although the PTL 10 described above utilizes two evaporators, it will be readily be understood that pulse thermal loops may be constructed which utilize three or more evaporators.

Figure 8:
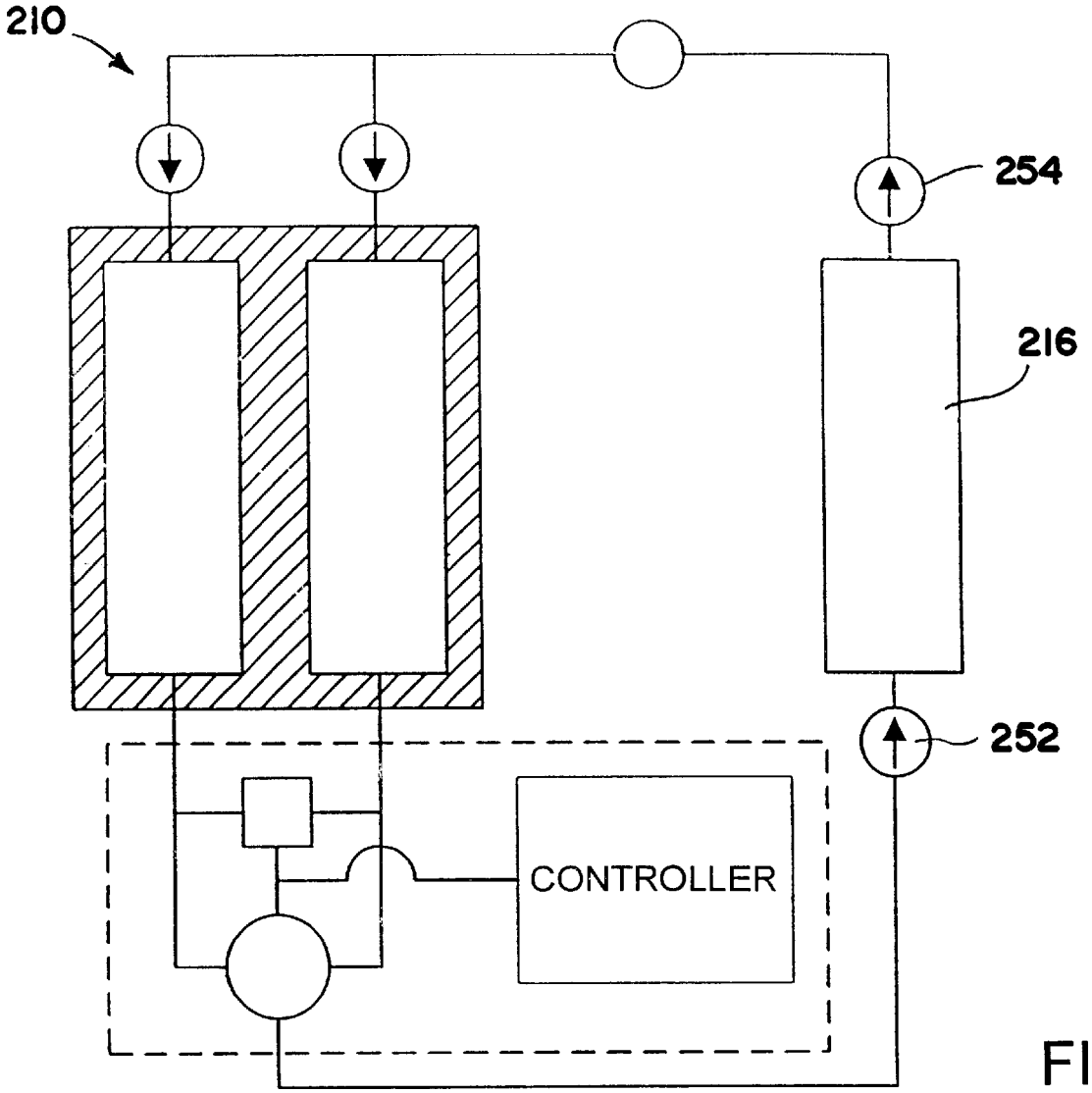
FIG. 8 is a schematic diagram of an additional embodiment pulsed thermal loop (PTL) in accordance with the present invention.

FIG. 8 shows an additional embodiment of the invention. The details of certain common similar features of the additional embodiment and the embodiment or embodiments described above are omitted in the description of the additional embodiments for the sake of brevity.

The PTL 210 shown in FIG. 8 has check valves 252 and 254 at respective inlet and outlet ends of its condenser 216. The check valves 252 and 254 may be used to aid in start up of the PTL 210. Start-up of a PTL may be as simple as adding heat to the evaporators. However, due to the myriad possible initial states in the PTL (various two-phase fluid distributions throughout the PTL), one or both of the check valves 252 and 254 may be employed to aid proper start up of the PTL 210. The outlet check valve 254 aids start up by ensuring that predominantly liquid flows out of the exit of the condenser 216. This reduces the likelihood of "dry pulsing" during start up. The inlet check valve 252 ensures predominantly vapor flowing into the inlet of the condenser 216.

The PTL 210 has the check valves 252 and 254 at both the inlet and outlet ends for redundancy and for increased reliability. Alternatively, it will be appreciated that one of the check valves 252 and 254 may be omitted, with a single check valve used to aid in start up of the PTL 210.

Figure 9:
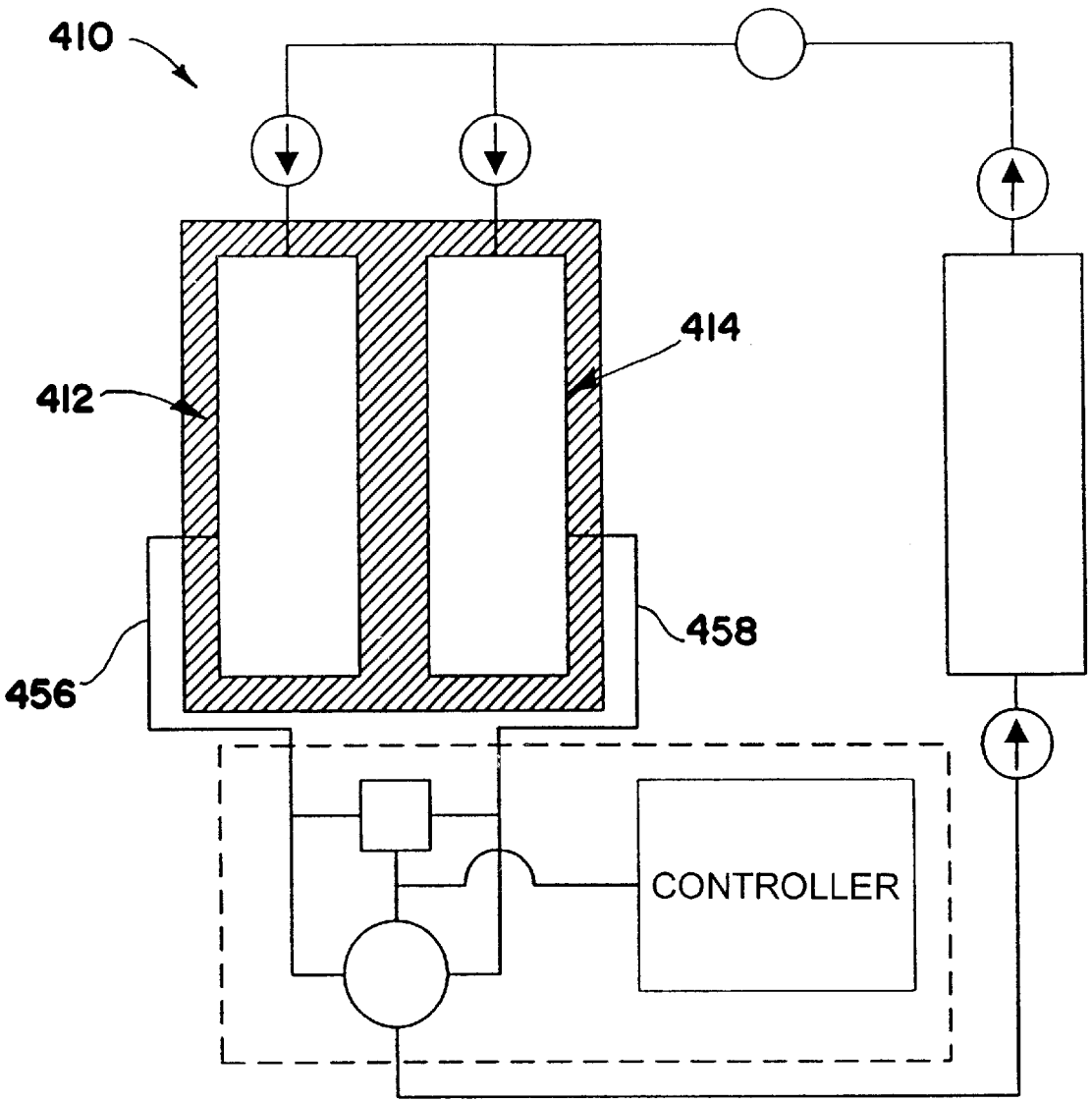
FIG. 9 is a schematic diagram of another additional embodiment pulsed thermal loop (PTL) in accordance with the present invention.

The above-described PTLs can function with a wide variety of liquid distributions within the system. However, it may be desirable for the liquid inventory to be fairly-well balanced between the evaporators and the condenser. A properly balanced system ensures the lowest operating temperature for a given heat input which is desirable for many applications. To passively maintain such balance over a wide range of operational parameters, one or more fluid positioning devices may be employed in the loop. Referring to FIG. 9, a PTL 410 has evaporators 412 and 414 with respective evaporator exit tubes 456 and 458 which are located other than at end of the evaporators. The locations of the evaporator exit tubes 456 and 458 in the evaporators 412 and 414 may be such that the amount of liquid in the evaporators is limited. When the liquid rises over a certain level in either of the evaporators 412 and 414, the liquid is ejected during a subsequent pulse.

Figure 10:
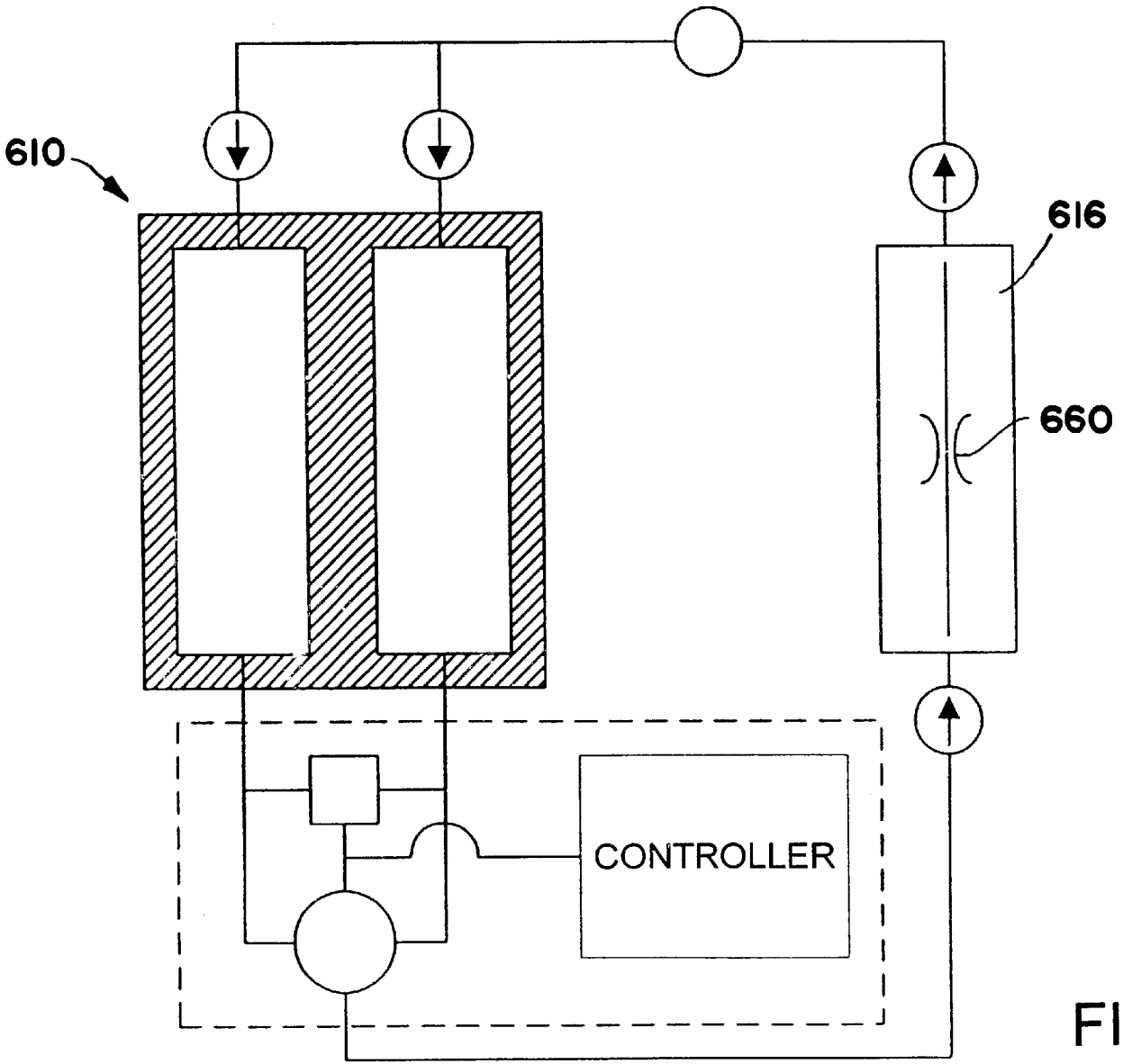
FIG. 10 is a schematic diagram of yet another additional embodiment pulsed thermal loop (PTL) in accordance with the present invention.

It will be appreciated that numerous other well-known approaches (some of which do not rely on gravity forces) may be alternatively or in addition be employed to accomplish the same effect. Such techniques limit and balance the maximum amount of liquid resident in the evaporators. For example, referring to FIG. 10, a PTL 610 has a condenser 616 with a flow restrictor 660. For conditions where the liquid inventory in the evaporators are imbalanced, the resistance from the flow restrictor 660 reduces the pumping capacity of the more dry evaporator and increases the pumping capacity of the more wet evaporator. The net effect is to redistribute the liquid contents of the loop equally between evaporators. The location of the restrictor 660 within the condenser 616 may be selected to minimized the operating temperature of the PTL 610. For example, the flow restrictor 660 may be located approximately ⅓ to ½ the distance along the condenser 616 from the condenser exit.

The pulse thermal loops and methods described above, then provide efficient heat transfer systems with a minimum of moving parts, able to generate high flow and heat transfer rates by use of iterative pulsing.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A pulse thermal loop heat transfer system comprising:

a pair of evaporators, each of the evaporators having an inlet and an outlet;

a condenser operatively coupled to the inlet of each of the evaporators; and one or more valves between the outlets and the condenser;

wherein the one or more valves are operatively configured to selectively couple one or the other of the outlets to the condenser.

2. The system of claim 1, further comprising a pair of check valves, wherein the inlets of each of the evaporators is operatively coupled to a respective of the check valves to prevent flow from the inlets to the condenser.

3. The system of claim 1, wherein the one or more valves includes a three-way solenoid valve.

4. The system of claim 1, further comprising a controller operatively coupled to the one or more valves.

5. The system of claim 4, wherein the controller is operatively configured to iteratively reconfigure a flow path between the evaporators and the condenser based on the occurrence of one or more triggering events.

6. The system of claim 5, wherein the controller is operatively coupled to one or more transducers for measuring one or more properties of the system.

7. The system of claim 4, further comprising one or more pressure transducers operatively configured to measure pressures of the evaporators, and wherein the one or more pressure transducers are operatively coupled to the controller.

8. The system of claim 7, wherein the controller is operatively configured to switch the configuration of the one or more valves based on a pressure difference between the evaporators.

9. The system of claim 1, wherein the evaporators are thermally coupled together.

10. The system of claim 1, further comprising a check valve at an inlet end of the condenser.

11. The system of claim 1, further comprising a check valve at an outlet end of the condenser.

12. The system of claim 1, further comprising a fluid positioning device.

13. The system of claim 12, wherein the fluid positioning device includes a flow restrictor in the condenser.

14. The system of claim 12, wherein the outlets of the evaporators are located other than at ends of the evaporators, and wherein the fluid positioning device includes one or more evaporator exit tubes coupled to the outlets.

15. The system of claim 1, wherein the evaporators are pressure decoupled from one another, such that the evaporators may be at substantially different pressures.

16. The system of claim 1, wherein the one or more valves includes a passive flow selector operatively configured to selectively couple one or the other of the outlets to the condenser.

17. The system of claim 16, wherein the passive flow selector includes a diaphragm operatively configured to block flow out of either one of the evaporators, while allowing flow out of the other of the evaporators.

18. A pulse thermal loop heat transfer system comprising:

a pair of evaporators, each of the evaporators having an inlet and an outlet;

a condenser operatively coupled to the inlet of each of the evaporators; and means for selectively operatively coupling each of the outlets of the evaporators to the condenser.

19. The system of claim 18, wherein the means for selectively operatively coupling includes means for operatively coupling one or the other of the outlets to the condenser.

20. The system of claim 18, wherein the means for selectively operatively coupling includes means for successively iteratively operatively coupling the outlets of the evaporators to the condenser.

21. The system of claim 18, further comprising a pair of check valves, wherein the inlets of each of the evaporators is operatively coupled to a respective of the check valves to prevent flow from the inlets to the condenser.

22. The system of claim 18, wherein the means for selectively operatively coupling includes a three-way solenoid valve.

23. The system of claim 22, wherein the means for selectively operatively coupling further includes a controller operatively coupled to the valve.

24. The system of claim 23, wherein the controller is operatively configured to iteratively reconfigure a flow path between the evaporators and the condenser based on the occurrence of one or more triggering events.

25. The system of claim 24, wherein the controller is operatively coupled to one or more transducers for measuring one or more properties of the system.

26. The system of claim 18, further comprising means of thermally coupling the evaporators together.

27. The system of claim 18, further comprising a fluid positioning device.

28. The system of claim 27, wherein the fluid positioning device includes a flow restrictor in the condenser.

29. The system of claim 28, wherein the outlets of the evaporators are located other than at ends of the evaporators, and wherein the fluid positioning device includes one or more evaporator exit tubes coupled to the outlets.

30. A pulse method of transferring thermal energy with a heat transfer fluid in a closed system, the system including a condenser and first and second evaporators, the method comprising iteratively switching between 1) putting the first evaporator into communication with the condenser to allow the heat transfer fluid to flow from the first evaporator to the condenser, while substantially blocking flow of the heat transfer fluid from the second evaporator to the condenser; and 2) putting the second evaporator into communication with the condenser to allow the heat transfer fluid to flow from the second evaporator to the condenser, while substantially blocking flow of the heat transfer fluid from the first evaporator to the condenser.

31. The method of claim 30, wherein the iteratively switching includes changing the configuration of one or more valves which are operatively coupled to the evaporators and the condensers.

32. The method of claim 31, wherein the one or more valves are operatively coupled to a controller, and the changing includes sending a signal from the controller to the one or more valves.

33. The method of claim 32, wherein the one or more valves includes a three-way solenoid valve and the controller includes a processor.

34. A pulse method of transferring thermal energy with a heat transfer fluid in a closed system, the system including a condenser and first and second evaporators, the method comprising iteratively performing the steps of:

configuring the system in a first configuration which allows flow of the fluid from the first evaporator to the condenser;

waiting for a first triggering event;

configuring the system in a second configuration which allows flow of the fluid from the second evaporator to the condenser; and waiting for a second triggering event.

35. The method of claim 34, wherein the first configuration includes substantially blocking flow of the fluid from the second evaporator to the condenser, and the second configuration includes substantially blocking flow of the fluid from the first evaporator to the condenser.

36. The method of claim 35, wherein the waiting for the first triggering event includes waiting during a first time period, wherein during a part of the first time period the fluid flows from the condenser to the second evaporator, and wherein during another part of the first time period the second evaporator is substantially sealed, with substantially no flow into or out of the second evaporator.

37. The method of claim 36, wherein, during at least some of the part of the first time period during which the fluid flows from the condenser to the second evaporator, the fluid is sprayed into the second evaporator.

38. The method of claim 34, wherein the configuring the system in the first and second configurations includes configuring one or more valves.

39. The method of claim 38, wherein the configuring the one or more valves includes a controller sending a signal to the one or more valves in response to the triggering events.

40. The method of claim 34, wherein the first evaporator has a first heating load imposed thereupon;

wherein the second evaporator has a second heating load imposed thereupon; and wherein the iteratively switching includes maintaining the first heating load on the first evaporator, and maintaining the second heating load on the second evaporator, throughout the method.

41. The method of claim 34, wherein the first evaporator has a first heating load imposed thereupon;

wherein the second evaporator has a second heating load imposed thereupon;

wherein the configuring the system in the first configuration includes maintaining the first heating load on the first evaporator, and maintaining the second heating load on the second evaporator; and wherein the configuring the system in the second configuration includes maintaining the first heating load on the first evaporator, and maintaining the second heating load on the second evaporator.

* * * * *